US006540313B2

(12) United States Patent
Suzuki

(10) Patent No.: US 6,540,313 B2
(45) Date of Patent: Apr. 1, 2003

(54) INK-JET RECORDING APPARATUS AND METHOD OF MANUFACTURING THE SAME

(75) Inventor: Shigeru Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/988,759

(22) Filed: Nov. 20, 2001

(65) Prior Publication Data

US 2002/0060704 A1 May 23, 2002

(30) Foreign Application Priority Data

Nov. 22, 2000 (JP) ..... 2000-355867

(51) Int. Cl.[7] ..... B41J 29/38; B41J 2/045

(52) U.S. Cl. ..... 347/5; 347/68; 347/71; 347/72

(58) Field of Search ..... 347/5, 9–12, 19, 347/68–72; 29/25.35

(56) References Cited

U.S. PATENT DOCUMENTS 5,266,964 A 11/1993 Takahashi et al. ..... 347/71
5,402,159 A * 3/1995 Takahashi et al. ..... 347/9
6,378,996 B1 * 4/2002 Shimada et al. ..... 347/70

* cited by examiner

*Primary Examiner*—Raquel Yvette Gordon
*Assistant Examiner*—An H. Do
(74) *Attorney, Agent, or Firm*—Oliff & Berridge, PLC

(57) ABSTRACT

A flexible flat cable having a driver integrated circuit (IC) thereon is soldered to a piezoelectric actuator of an ink-jet head. A power source equivalent to a power source that generates a voltage required for ink ejection is connected, through a lead wire, to each electrode provided on one side of each piezoelectric element. A negative power source is connected, through another lead wire, to each electrode provided on the other side of each piezoelectric element, that is, on the opposite side from the driver IC. After the piezoelectric actuator is coupled to the flexible flat cable, the piezoelectric elements are polarized using these two power sources.

20 Claims, 7 Drawing Sheets

INK-JET RECORDING APPARATUS AND METHOD OF MANUFACTURING THE SAME

BACKGROUND OF THE INVENTION

1. Field of Invention

The invention relates to an ink-jet recording apparatus and a method of manufacturing the same.

2. Description of Related Art

An ink-jet type recording apparatus is known and typically used for recording image data outputted from a personal computer, a facsimile machine, and the like. This type of recording apparatus is superior to other types of recording apparatus in that it is quiet and capable of recording on sheets of various materials.

U.S. Pat. No. 5,402,159 discloses a piezoelectric element formed by stacking a plurality of layers of piezoelectric material. Each layer is sandwiched by a pair of opposed electrodes and is polarized in the opposing direction of the pair of opposed electrodes. The structure is produced by lamination with the various layers pressed while applying heat thereto. Then external negative electrodes and external positive electrodes are bound to the electrode leads. After which the laminate is immersed in an oil bath filled with an oil, such as silicon oil, heated to about 130° C. and an electric field is applied between the external negative electrodes and the external positive electrodes to provide polarization. Following that, the piezoelectric element is then assembled within a channel body and an orifice plate to provide the ejector array.

U.S. Pat. No. 5,266,964 discloses a print head having a similarly constructed piezoelectric element. The piezoelectric element is made up of a plurality of layers each of which has mounted on an upper surface of alternating negative and positive electrodes. The negative electrodes are positioned above partitions of a channel structure when assembled to provide the piezoelectric print head. The positive electrodes are positioned above what will be the ink channels. Outside polarizing electrodes are then placed on both the top and bottom surfaces and the laminate is placed within an insulating oil, such as silicon oil, again at a temperature of about 130° C. and an electric field is passed by the outside polarizing electrodes. Thus, the piezoelectric element is polarized. The laminated piezoelectric element is then removed from the oil, the outside polarizing electrodes are removed, and the piezoelectric element then assembled to a channel block and nozzle plate to produce the print head.

Thus, in both of the disclosed methods, the laminated piezoelectric elements are polarized before they are assembled with the cavity plate, that is, the channel body or block having the ink channels, and connected to an electric circuit. Such a procedure is difficult and cumbersome involving a number of steps to obtain the piezoelectric element. Further, polarized conditions of the piezoelectric elements may be affected by the steps performed following the polarizing step.

SUMMARY OF THE INVENTION

The invention provides an ink-jet printing apparatus having improved polarized piezoelectric elements and a method of manufacturing the same.

According to an aspect of the invention, an ink-jet printing apparatus is manufactured by stacking a plurality of plates to form a cavity plate that has a plurality of nozzles and a plurality of cavities communicating with their respective nozzles, and by forming an piezoelectric actuator that has a plurality of piezoelectric elements, each of which is sandwiched by a pair of opposed electrodes. Then, the piezoelectric actuator is fixed to the cavity plate such that the plurality of piezoelectric elements face their respective cavities. A flexible cable is connected to each pair of opposed electrodes. Thereafter, each piezoelectric element is polarized in an opposing direction of each pair of opposed electrodes by applying a first voltage by a first power source to each piezoelectric element through the flexible cable and by applying a second voltage different from the first voltage by a second power source to each piezoelectric element through the flexible cable.

BRIEF DESCRIPTION OF THE DRAWINGS

A preferred embodiment of the invention will be described with reference to the following figures wherein.

DETAILED DESCRIPTION OF PREFERRED EMBODIMENTS

Figure 1:
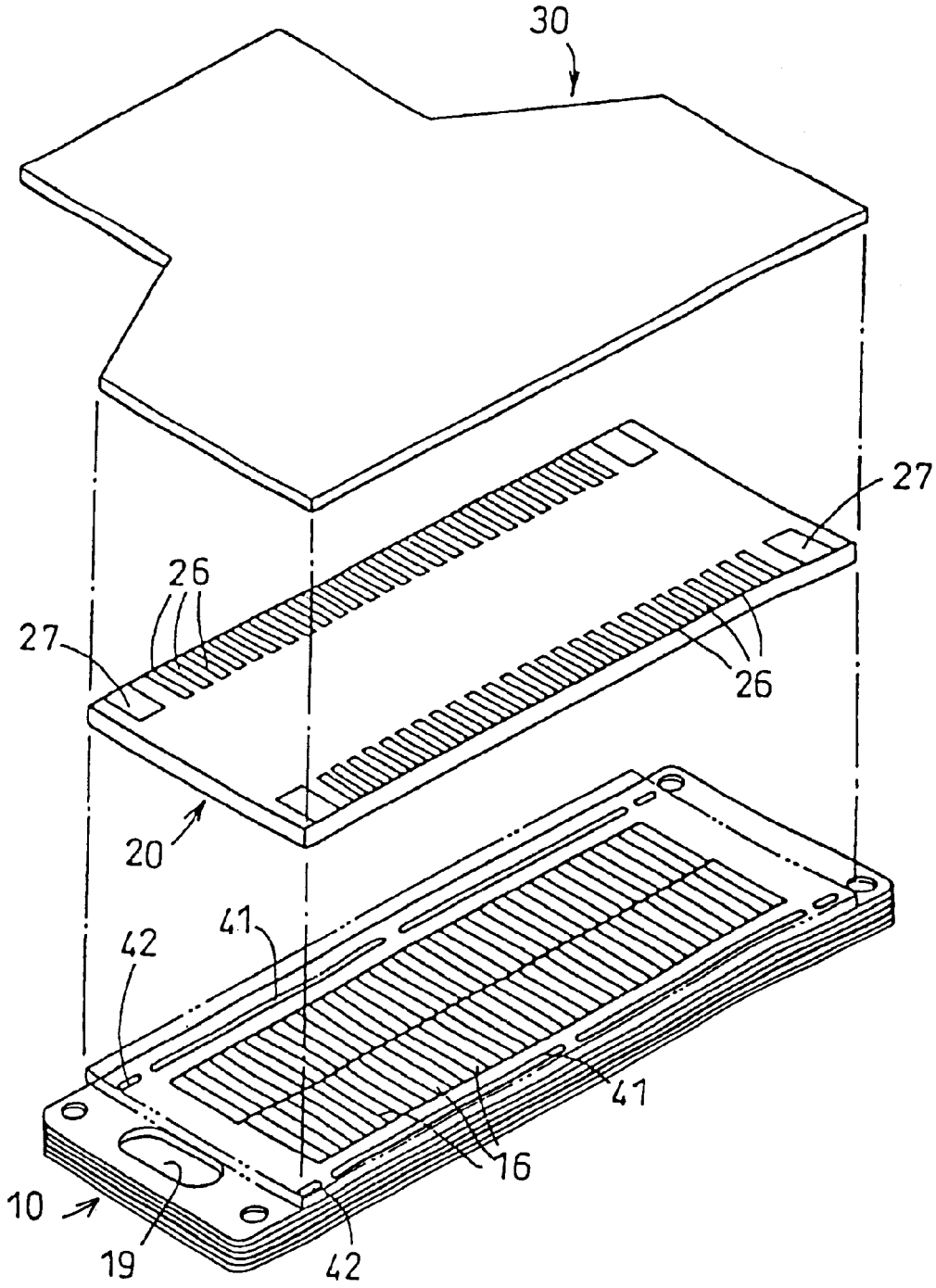
FIG. 1 is an exploded perspective view of part of an ink-jet head.

One embodiment of the invention will be described with reference to the accompanying drawings. FIG. 1 is an exploded perspective view of part of an ink-jet head. As shown in FIG. 1, an ink-jet head is formed by stacking a cavity plate 10, a piezoelectric actuator 20, and a flexible flat cable 30 in order from the bottom. The cavity plate 10 is provided with cavities 16 and a supply hole 19, for supplying ink to the ink-jet head. The cavity plate 10 is formed by stacking five plates. The piezoelectric actuator 20 is provided with surface electrodes 26, 27 through which electric current passes to the piezoelectric elements.

Figure 2A:
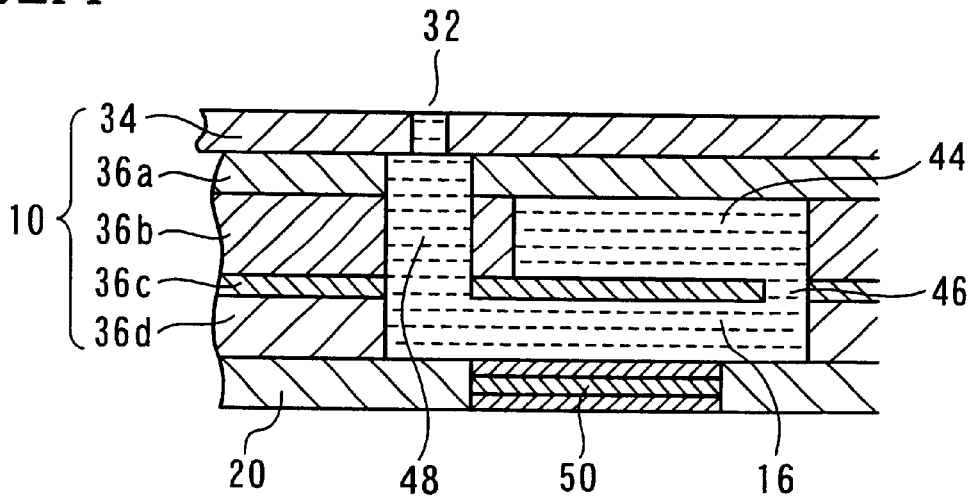
FIGS. 2A, 2B, 3A and 3B are cross-sectional views showing how ink is ejected from an ink-jet head.

FIGS. 2A, 2B, 3A, and 3B are vertical cross-sectional views of the ink-jet head taken along a direction perpendicular to its longitudinal direction when the cavity plate 10 and the piezoelectric actuator 20 are stacked upside down relative to the state shown in FIG. 1. As shown in FIG. 2A, the cavity plate 10 is formed by stacking five plates, namely, a nozzle plate 34, a first plate 36*a*, a second plate 36*b*, a third plate 36*c*, and a fourth plate 36*d*. A manifold 44, a restrictor orifice 46, a cavity 16, and a communication passage 48 are formed in the stacked plates 36*a*–36*d*. A nozzle 32 is formed in the nozzle plate 34, and ink in the communication passage 48 is ejected thorough the nozzle 32. The manifold 44 communicates with the supply hole 19 through a passage (not shown). In the ink-jet head, 75 sets of cavities 16 and nozzles 32 are arrayed in a row and another 75 sets of cavities and nozzles, which are bilaterally symmetrical with those shown in FIGS. 2A, are arrayed in a row. A total of 150 sets of cavities are arrayed in two rows such that 150 nozzles are aligned in a row along a center line of the nozzle plate 34. The piezoelectric actuator 20 is provided with a plurality of piezoelectric elements 50, which are placed adjacent to the cavities 16.

Figure 2B:
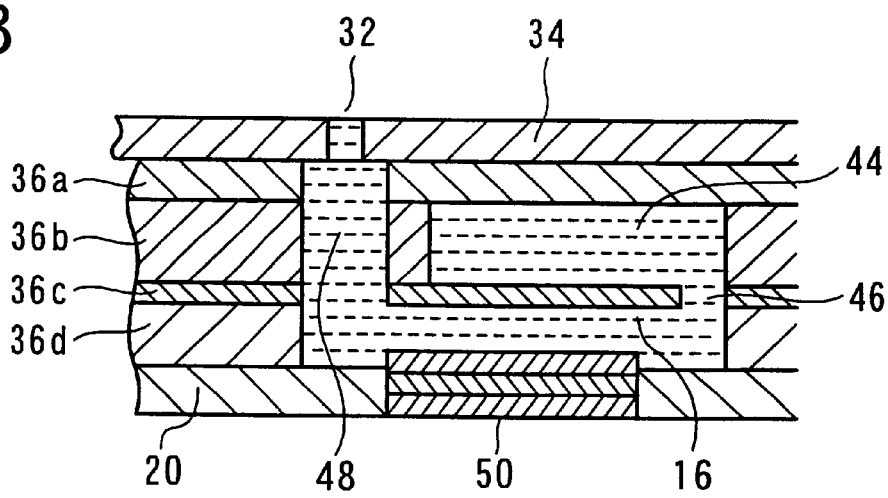
Figure 3A:
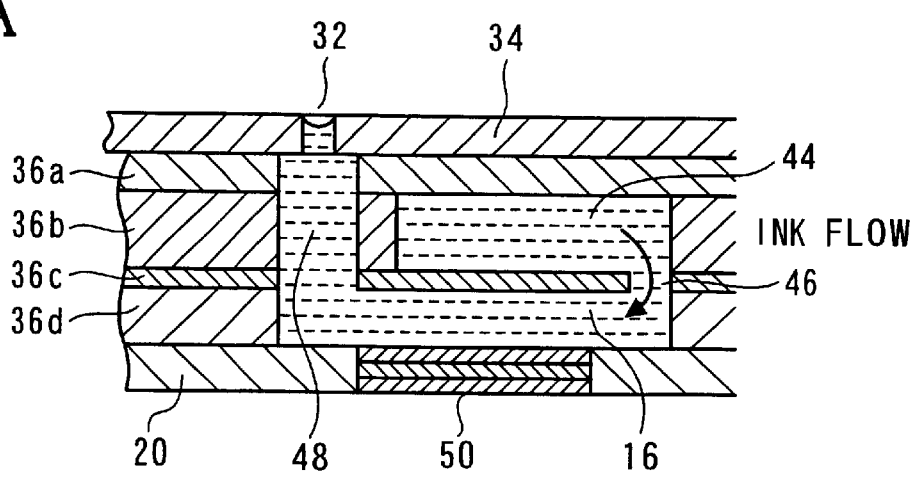
Figure 3B:
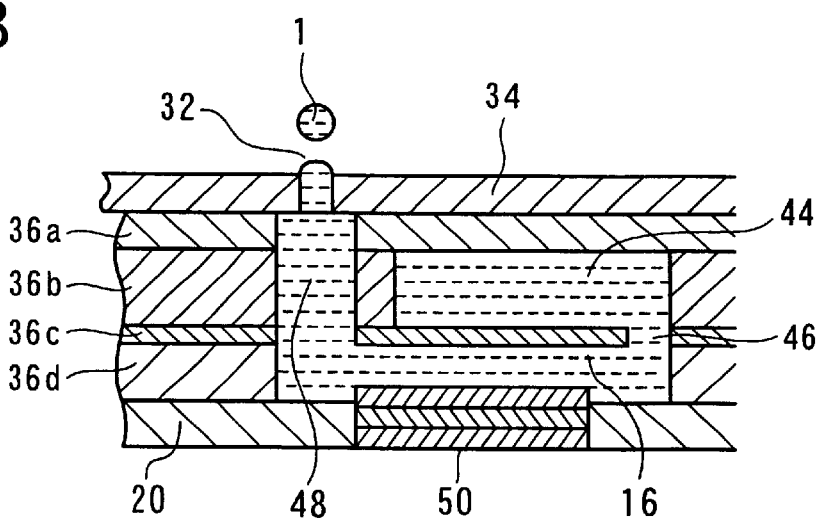

In a normal state shown in FIG. 2B, a voltage is applied to the piezoelectric element 50 to vertically expand the piezoelectric element 50. When the application of a voltage to the piezoelectric element 50 is stopped, the piezoelectric element 50 contracts, as shown in FIG. 3A, and a negative pressure is developed in the cavity 16. Then, ink flows from the manifold 44 to the cavity 16. Upon reapplication of a voltage to the piezoelectric element 50, the piezoelectric element 50 expands again, as shown in FIG. 3B, and the ink that has flowed into the cavity 16 is pressurized and ejected as an ink droplet I from the nozzle 32. The above-described operation is repeated a specified number of times, according to a drive waveform supplied from a control circuit to the ink-jet head, to form a dot having the desired density.

Figure 4:
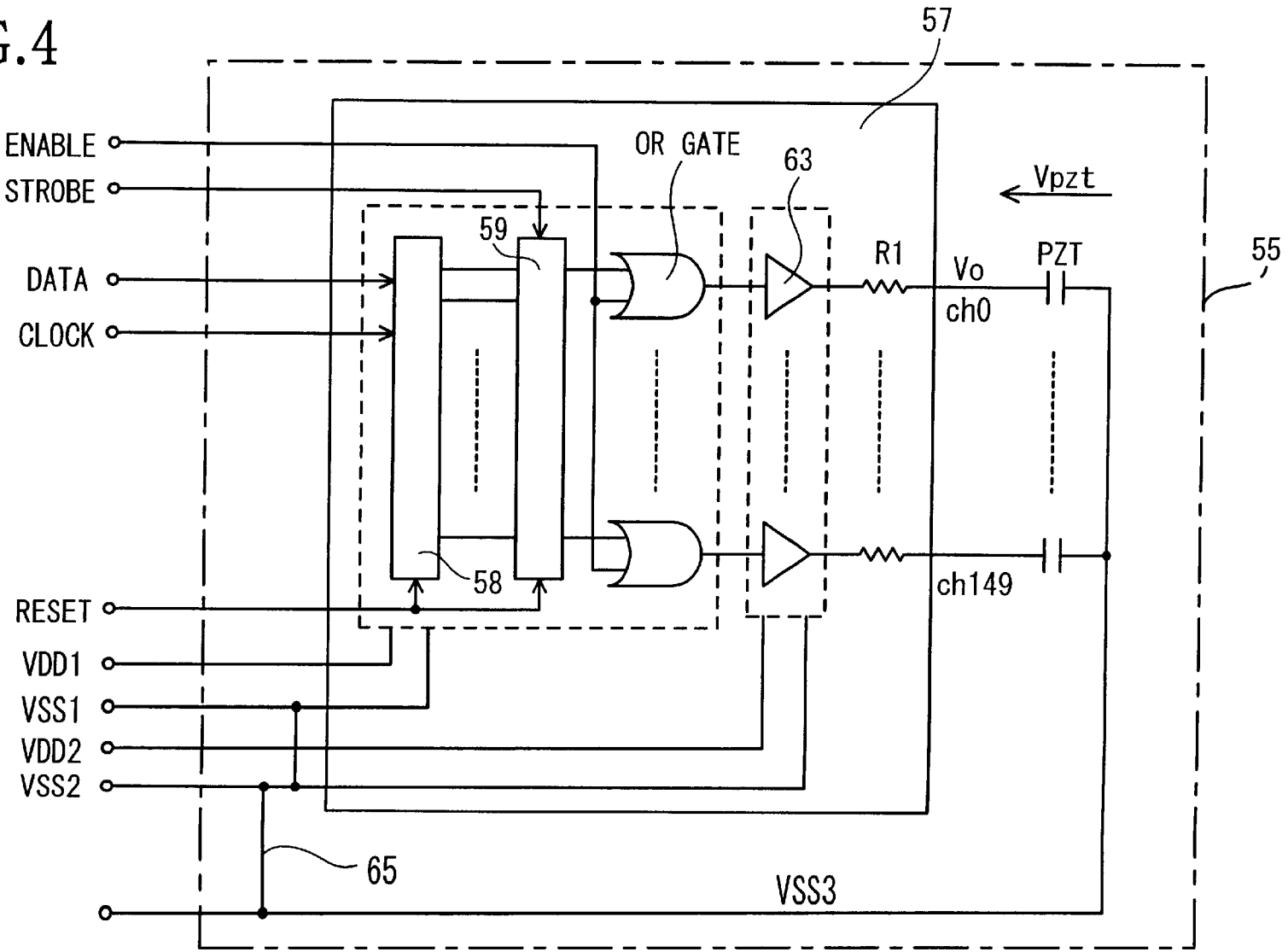
FIG. 4 is a circuit diagram showing the connection between an ink-jet head and a control circuit of an ink-jet printing apparatus according to the invention.

As shown in FIG. 4, a driver IC (integrated circuit) 57 for driving piezoelectric elements PZT includes shift registers 58, D flip-flops 59, and drivers 63. There are 150 shift registers 58 and 150 D flip-flops 59 to correspond to the number of nozzles. Lead wires VDD1, VSS1 are provided to supply a drive voltage to the shift registers 58 and the D flip-flops 59. Also, 150 drivers 63 and 150 piezoelectric elements 50 designated by reference symbol PZT are provided. Lead wires VDD2, VSS2 are provided to supply a drive voltage (30 V in this embodiment) to the drivers 63 and the piezoelectric elements PZT. A lead wire VSS3 is commonly connected to the electrodes provided, on the opposite side from the driver IC 57, for the piezoelectric elements PZT. The lead wire VSS3 and the lead wire VSS2 are interconnected by a lead wire 65. The lead wire VSS2 is commonly connected to the common-potential, normally grounded sides of the drivers 63. The driver IC 57 is mounted on the flexible flat cable 30, and the above-described lead wires and signal lines (to be described later), such as an enable signal line, are formed on the flexible flat cable 30.

Figure 5:
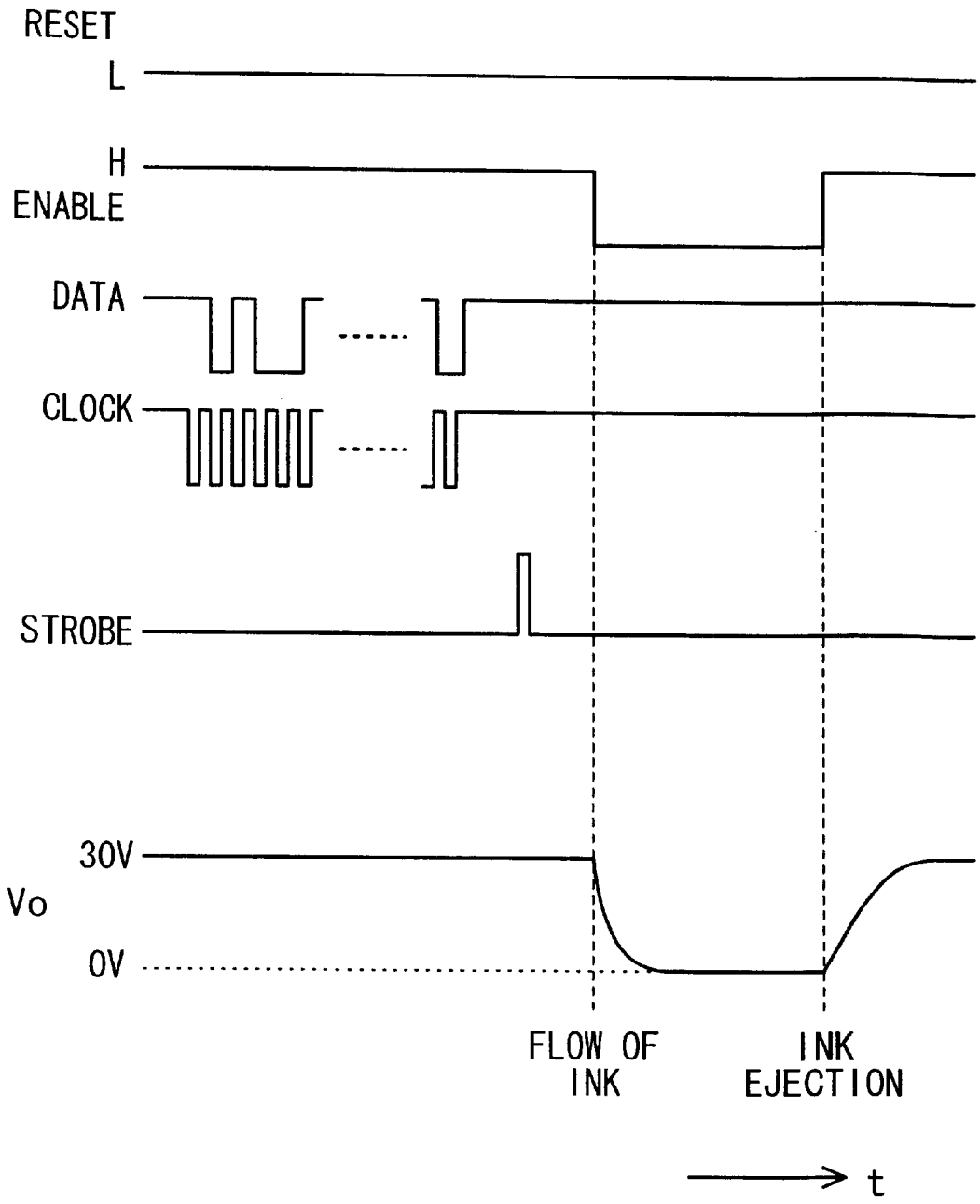
FIG. 5 is a timing chart of signals used for ink ejection from the ink-jet head.

Referring now to a timing chart in FIG. 5, the operation for ink ejection will be described. When a reset signal for the shift registers 58 and the D flip-flops 59 is at a low (L) level, print data (0: ink ejection, 1: no ink ejection) is serially read from an image memory, inputted to the shift registers 58, and converted to parallel data corresponding to the number of nozzles of the ink-jet head 55. Then, the print data converted to the parallel data is latched by the D flip-flops 59 and outputted to OR gates in synchronism with a strobe signal. In a normal state, an enable signal at a high (H) level is applied to each OR gate to turn on each driver 63. A voltage (30 V) carried by the lead wire VDD2 is applied to each piezoelectric element 50 to bring each piezoelectric element 50 into a state shown in FIG. 2B. With a little delay after the strobe signal, the enable signal is switched to a low (L) level and is kept at a low (L) level for a predetermined period of time. At this time, if the data latched by any D flip-flop 59 is 1, which indicates no ink ejection, the corresponding driver 63 remains on to keep the corresponding piezoelectric element 50 in a state shown in FIG. 2B. Thus, no ink ejection is caused. If the data latched by any D flip-flop 59 is 0, which indicates ink ejection, the corresponding driver 63 is turned off to bring the corresponding piezoelectric element into a state shown in FIG. 3A. Thus, ink flows into the corresponding cavity 16. Then, when the enable signal returns to a high (H) level after the predetermined period of time, the outputs of the OR gates are again at a high (H) level, and the drivers 63 restart energizing the piezoelectric elements PZT. As a result, any piezoelectric element PZT having been in a state shown in FIG. 3A is brought into a state shown in FIG. 3B, and ink is ejected.

Figure 6:
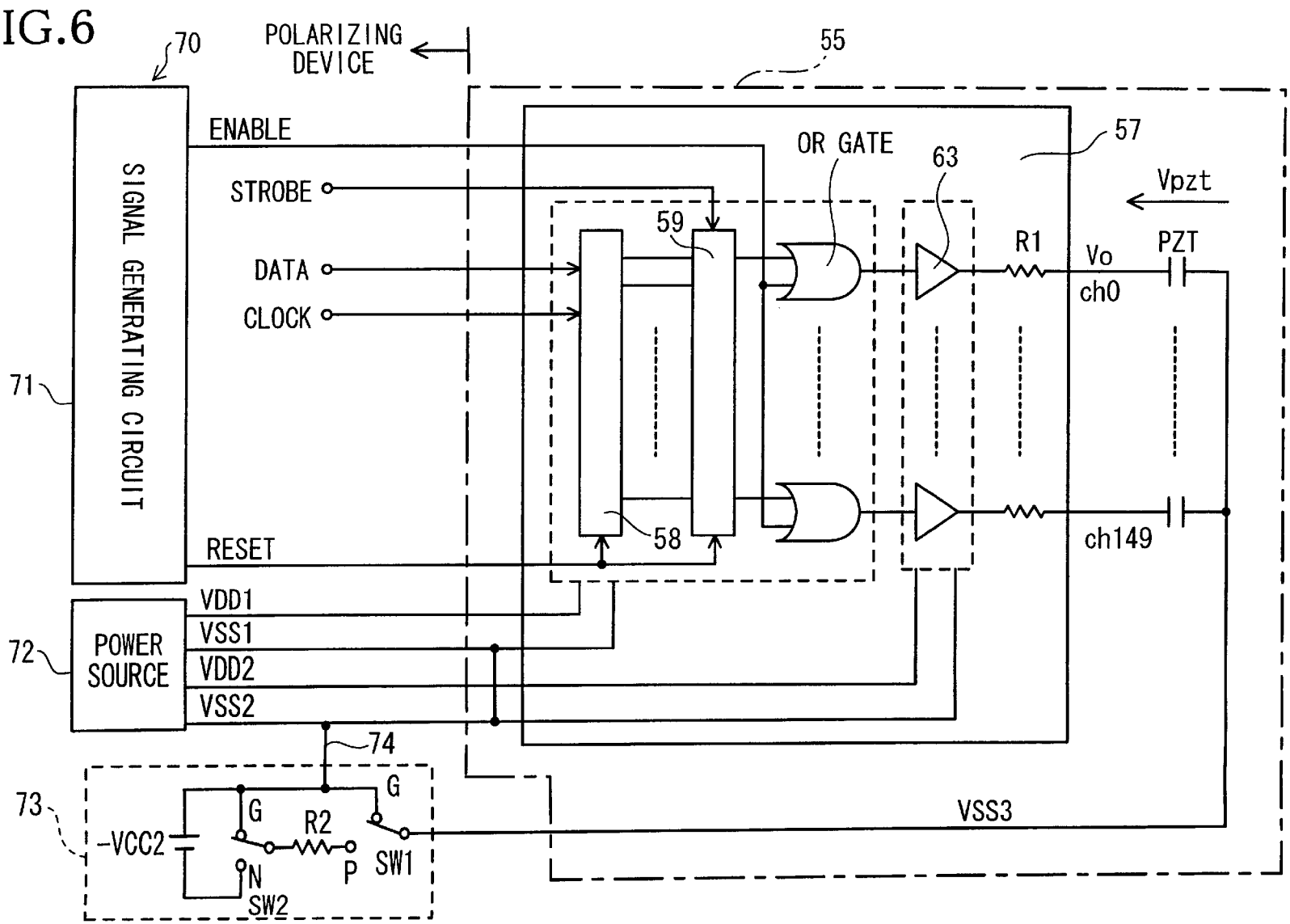
FIG. 6 is a circuit diagram of a polarizing device for the ink-jet head of the ink-jet printing apparatus according to the invention.

The manufacturing process for the ink-jet head 55 will be described. After the piezoelectric actuator 20 is stacked on the cavity plate 10, the flexible flat cable 30 is soldered to the surface electrodes 26, 27 on the piezoelectric actuator 20. Then, each piezoelectric element PZT of the piezoelectric actuator 20 is polarized. As shown in FIG. 6, a polarizing device 70 includes a circuit 73 that generates part of a polarizing voltage, a power source 72 that generates the remaining part of the polarizing voltage and is equivalent to a power source used for performing the above-described ink ejection, and a circuit 71 that generates enable, reset, and other signals. Because the power source 72 and the signal generating circuit 71 are equivalent to those conventionally provided for ink ejection in a printer, a detailed description thereof will be omitted.

Figure 7:
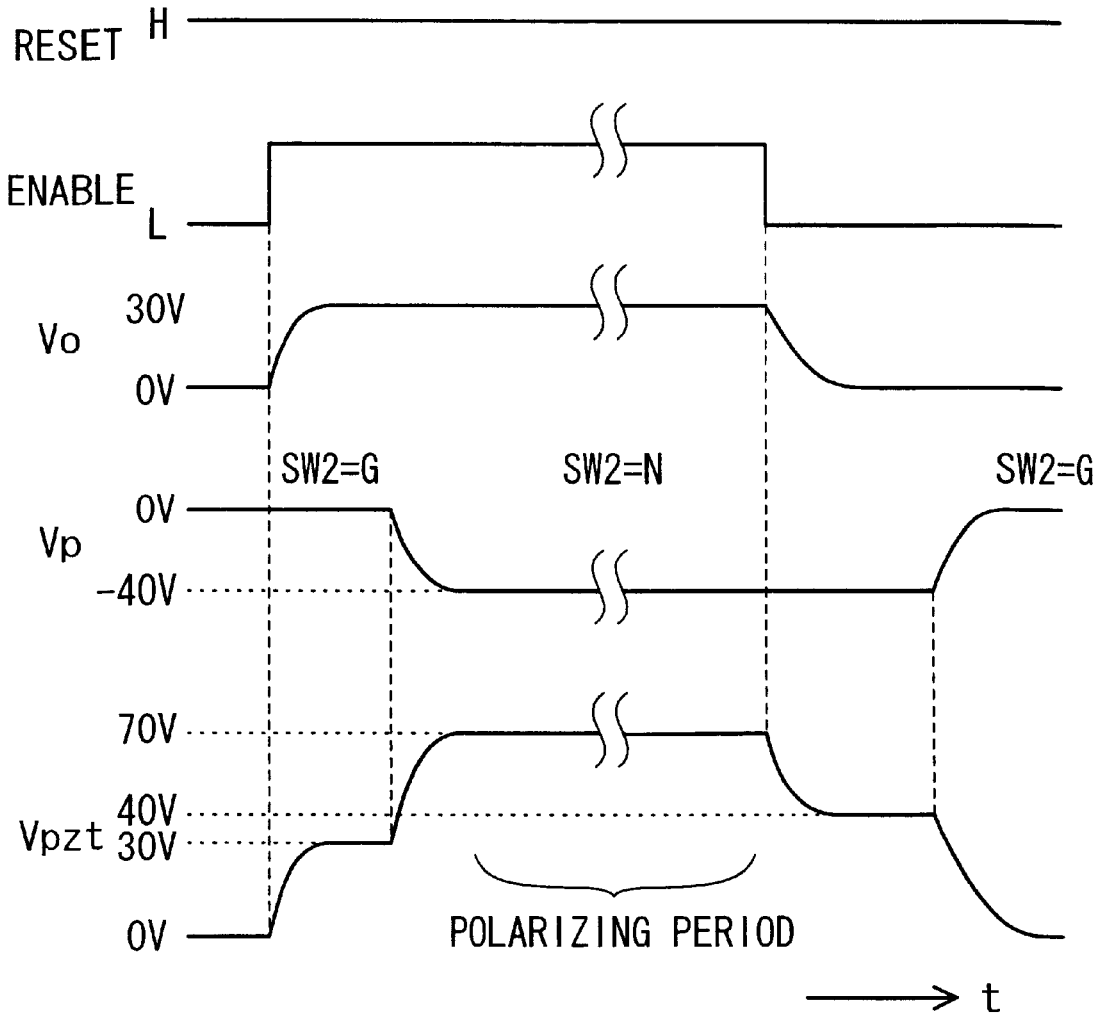
FIG. 7 is a timing chart of signals used to polarize piezoelectric elements.

The circuits 71, 73 and power source 72 are connected to terminals of the above-described lead wires and signal lines, which are formed on the flexible flat cable 30. The circuit 73 is used for applying a polarizing voltage across the lead wires VSS3, VSS2. The lead wire VSS3 is commonly connected to one of two electrodes provided for each piezoelectric element PZT. The lead wire VSS2 is commonly connected to common-potential sides (grounded sides) of the drivers 63. The circuit 73 includes a negative power source −VCC2, switches SW1, SW2, and a resistance R2. The power source 72, which is equivalent to a power source used for performing the above-described ink ejection, is connected between the lead wires VDD1, VSS1, and between the lead wires VDD2, VSS2. At this time, the lead wire 65 (FIG. 4) is not connected between the lead wires VSS2, VSS3. Instead, another lead wire 74 is connected between the lead wires VSS2 and the grounded (G) side of the circuit 73. In this state, the piezoelectric elements PZT are polarized. Polarization of the piezoelectric elements PZT will be described in detail with reference to FIG. 7. When polarization is performed, the switch SW1 is set at position G and the switch SW2 at position G so that the negative power source −VCC2 is disconnected from the lead wire VSS3 and the lead wire VSS2 is connected to the lead wire VSS3 through the lead wire 74.

In this state, the reset signal for the shift registers 58 and the D flip-flops 59 is set at a high (H) level, and all the data for the shift registers 58 and the D flip-flops 59 are set to 0, which indicates ink ejection. Then, when the enable signal is switched from a low (L) level to a high (H) level, the outputs of the OR gates become at a high (H) level, and all the drivers 63 start energizing the piezoelectric elements PZT. At this time, because the switches SW1, SW2 are set at positions G, a voltage Vpzt applied to each piezoelectric element PZT is 30 V (a voltage drop due to the resistance R1 is ignored here). This voltage Vpzt is the same as the voltage applied to the piezoelectric element PZT during ink ejection, and thus polarization is not performed.

After a predetermined period of time has elapsed in this state, the switches SW1, SW2 are switched to positions P, N, respectively. A voltage (−40 V in this embodiment) is additionally applied by the negative power source −VCC2 to each piezoelectric element PZT through the lead wire VSS3, and the total voltage Vpzt applied across each piezoelectric element PZT becomes 70 V (a voltage drop due to the resistance R2 is ignored here). Polarization is started with this voltage. After a predetermined period of time has elapsed in this state, the enable signal is set at a low (L) level. Because the outputs of the D flop-flops 59 are set at a low (L) level by the reset signal, when the enable signal is set at a low (L) level, the outputs of the OR gates become set at a low (L) level. As a result, the drivers 63 stop energizing the piezoelectric elements PZT, and only a voltage of −40 V is applied by the negative power source −VCC2 to the piezoelectric elements PZT. After a predetermined period of time has elapsed in this state, the switch SW2 returns to position G, and the voltage Vpzt applied to each piezoelectric element PZT becomes zero. By now polarization is completed. As a result, each piezoelectric element is polarized in a direction from a high-voltage side to a low-voltage side, that is, in a direction from the driver IC 57 to the lead wire VSS3. Thereafter, the polarizing device 70 is removed from the flexible flat cable 30, the lead wires VSS2, VSS3 are interconnected by the lead wire 65, and the ink-jet head 55 can be attached to a printer.

By connecting the lead wire VSS3 and the lead wire VSS2 and by connecting a power source for ink ejection to the lead wire VDD2, a voltage for ink ejection can also be applied to the piezoelectric elements PZT. Accordingly, the lead wire VSS3 can also be effectively used in the ink-jet printing apparatus.

In the described manufacturing method, polarization is performed after the flexible flat cable 30 has been soldered to the ink-jet head 55. Thus, the polarization is not deteriorated by soldering. In addition, polarization is performed by reducing, relative to a voltage required for ink ejection, the potential of each electrode provided, on the opposite side from the driver IC 57, for each piezoelectric element. Thus, a high voltage is not applied to the driver IC 57, and thus a breakdown of the driver IC 57 is prevented during polarization.

In addition, because the polarizing voltage is generated by the electrodes provided on both sides of each piezoelectric element PZT, absolute values of the potentials of the electrodes on both sides of each piezoelectric element PZT can be small. This facilitates designing an ink-jet printing apparatus. On the contrary, if the potential of one of two electrodes provided for each piezoelectric element PZT is set at zero to obtain a voltage necessary for polarization, the potential of the other electrode must be greatly increased. This makes designing an ink-jet printing apparatus difficult.

When the polarizing voltage is applied through the lead wire VDD2, the output voltage V0 of the driver IC 57 is the voltage carried by the lead wire VDD2 (30 V), and thus electric current flows from the driver IC 57 to each piezoelectric element PZT. When the polarizing voltage carried by the lead wire VDD2 is discharged, the output voltage V0 of the driver IC 57 is zero (0 V), and thus electric current flows from each piezoelectric element PZT to the driver IC 57.

Accordingly, the output voltage V0 of the driver IC 57 ranges from 0 V to 30 V (a voltage carried by the lead wire VDD2), the driver IC 57 is less likely to break down during polarization.

Because the polarizing voltage is applied step by step by the power source 72 and then by the negative power source −VCC2, any excessive impact of the polarizing voltage on the ink-jet printing apparatus is reduced. In addition, because a voltage equivalent to the voltage for ink ejection is applied first by the power source 72, the driver IC 57 is not adversely affected.

In addition, after application of a voltage by the power source 72 has been stopped, application of a voltage by the negative power source −VCC2 is stopped. Thus, electric current is prevented from flowing from the negative power source −VCC2 to the power source 72, that is, flowing to the driver IC 57. Thus, a breakdown of the driver IC 75 is prevented.

Although, in the above-described embodiment, the power source equivalent to a power source for ink ejection is connected to the lead wires VDD2, VSS2, a power source for ink ejection itself can be used as the power source to be connected to the lead wires VDD2, VSS2.

Although the invention has been described with reference to a specific embodiment, the description of a specific embodiment is illustrative only and is not be construed as limiting the scope of the invention. Various other modifications and changes may occur to those skilled in the art without departing from the spirit and scope of the invention.

What is claimed is:

1. A method of manufacturing an ink-jet printing apparatus, comprising the steps of:

stacking a plurality of plates to form a cavity plate that has a plurality of nozzles and a plurality of cavities communicating with their respective nozzles;

forming an piezoelectric actuator that has a plurality of piezoelectric elements, each of which is sandwiched by a pair of opposed electrodes;

fixing the piezoelectric actuator to the cavity plate such that the plurality of piezoelectric elements face their respective cavities:

connecting a flexible cable to each pair of electrodes; and polarizing each piezoelectric element in an opposing direction of each pair of electrodes by applying a first voltage to each pair of electrodes through the flexible cable and by applying a second voltage different from the first voltage to each pair of electrodes through the flexible cable.

2. The method according to claim 1, wherein in the polarizing step, the first voltage applied to each pair of electrodes is equivalent to a voltage applied to each pair of electrodes to cause deformation thereof for ink ejection.

3. The method according to claim 2, wherein in the polarizing step, the second voltage is a voltage opposite in polarity to the first voltage.

4. The method according to claim 3, wherein in the polarizing step, application of the second voltage is started after application of the first voltage has been started.

5. The method according to claim 4, wherein in the polarizing step, application of the second voltage is stopped after application of the first voltage has been stopped.

6. The method according to claim 5, wherein the flexible cable connecting step further includes:

connecting an ink ejection control circuit provided on the flexible cable to one of each pair of electrodes; and commonly connecting a first lead wire provided on the flexible cable to the other of each pair of electrodes, and the polarizing step further includes:

applying the first voltage to one of each pair of electrodes through the ink ejection control circuit; and applying the second voltage to the other of each pair of electrodes through the first lead wire.

7. The method according to claim 6, wherein the polarizing step further includes:

applying the first voltage across second and third lead wires provided on the flexible cable, the second lead wire being commonly connected to a common-potential side of the ink ejection control circuit, and the third lead wire being connected to a driving side of the ink ejection control circuit to carry a piezoelectric element driving voltage; and applying the second voltage across the first and second lead wires.

8. The method according to claim 7, further comprising connecting the first lead wire and the second lead wire after application of the second voltage is stopped.

9. A polarizing device for polarizing a plurality of piezoelectric elements for use in an ink-jet print head, the polarizing device comprising:

a first power source connected to one of each pair of electrodes that sandwich each piezoelectric element; and a second power source connected to the other of each pair of electrodes, wherein the first power source applies to each piezoelectric element a first voltage equivalent to a voltage applied thereto during ink-jet printing, and the second power source applies to each piezoelectric element a second voltage different from the first voltage applied by the first power source, thereby polarizing each piezoelectric element.

10. The polarizing device according to claim 8, the second voltage applied by the second power source is a voltage opposite in polarity to the first voltage applied by the first power source.

11. The polarizing device according to claim 8, application of the second voltage by the second power source is started after application of the first voltage by the first power source has been started.

12. The polarizing device according to claim 8, wherein application of the second voltage by the second power source is stopped after application of the first voltage by the first power source has been stopped.

13. A device for polarizing a piezoelectric element associated with a print nozzle for an ink-jet printhead having a plurality of print nozzles, after assembly of the printhead to include soldering a flexible cable to the printhead for carrying signals and a voltage, the device comprising:

a signal generating circuit;

a first power source; and a polarizing circuit including a second power source for generating a negative current, wherein the signal generating circuit, the first power source and the polarizing circuit are removably, electrically connected to the flexible cable.

14. The device according to claim 13, further comprising a shunt between a lead line from the first power source to a grounded side of the polarizing circuit.

15. The device according to claim 14, wherein the polarizing circuit further comprises a first switch and a second switch, the shunt connected between the first switch and the second switch.

16. The device according to claim 13, wherein the polarizing circuit further comprises a first switch and a second switch.

17. The device according to claim 16, further comprising a shunt between a lead line from the first power source to a grounded side of the polarizing circuit.

18. The device according to claim 17, wherein the shunt is connected to the polarizing circuit between the first switch and the second switch.

19. The device according to claim 15, wherein a first position of each of the first switch and the second switch is a ground position and the first power source provides a voltage to the piezoelectric element and a second position of each of the first switch and the second switch connects the negative voltage of the second power source to the piezoelectric element.

20. The device according to claim 18, wherein a first position of each of the first switch and the second switch is a ground position and the first power source provides a voltage to the piezoelectric element and a second position of each of the first switch and the second switch connects the negative voltage of the second power source to the piezoelectric element.

* * * * *